US005581893A

United States Patent [19]

Ouellette

[11] Patent Number: 5,581,893

[45] Date of Patent: Dec. 10, 1996

[54] PROTECTIVE GUARD FOR A UTILITY KNIFE

[76] Inventor: Shawn Ouellette, 6 Albert St., Madawaska, Me. 04576

[21] Appl. No.: 534,120

[22] Filed: Sep. 25, 1995

[51] Int. Cl.[6] ..... B26B 29/02

[52] U.S. Cl. ..... 30/286; 30/295

[58] Field of Search ..... 30/286, 295, 2, 30/294, 289

[56] References Cited

U.S. PATENT DOCUMENTS

| | | | |
|---|---|---|---|
| 604,624 | 5/1898 | Marble | 30/286 |
| 1,452,893 | 4/1923 | Porth | 30/286 |
| 2,376,887 | 5/1945 | Walters | 30/2 |
| 2,730,800 | 1/1956 | Bailey | 30/286 |
| 3,781,988 | 1/1974 | Jones | 30/286 X |
| 4,086,698 | 5/1978 | Sparks | 30/286 X |
| 4,091,537 | 5/1978 | Stevenson, Jr. | 30/286 |
| 4,987,682 | 1/1991 | Minnick | 30/295 |

*Primary Examiner*—Hwei-Siu Payer
*Attorney, Agent, or Firm*—Frederick R. Cantor, Esq.

[57] ABSTRACT

A utility knife can be equipped with a removable blade protective guard structure to prevent the person from being cut when the knife is not in use. The guard structure includes a mounting element having a pivotable connection with an elongated guard element near the leading end of the knife handle. A torsion spring is coiled around the pivot shaft to normally urge the guard element to a position extending along the cutting edge of the blade. However, the guard element can be swung through an arc of about one hundred eighty degrees (180) to assume a position lying alongside a side edge of the knife handle, away from the cutter blade.

5 Claims, 2 Drawing Sheets

PROTECTIVE GUARD FOR A UTILITY KNIFE

BACKGROUND OF THE PRESENT INVENTION

1. Field of the Invention

This invention relates to utility knives usable for cutting cardboard, twine, plastic materials, thin wood, shrubbery, etc. More particularly, the invention relates to a protective guard structure for preventing injury to a person while holding a utility knife in his hand or storing such a knife in his pocket.

2. Prior Developments

Various types of guard structures for utility knives have been proposed. However such guard structures differ in material respects from the guard structure herein proposed. The herein-proposed guard structure is designed for use with a conventional utility knife, such that the guard structure can be supplied as an attachment to utility knife structures already in use; users of existing knife structures are enabled to purchase the guard structure without having to purchase a new knife.

A further feature of the herein-proposed guard structure is that it is automatically biased to the blade protective position when the person releases his grip on the knife handle. The person does not have to consciously think about moving the guard structure to its protective position, as movement to the protective position is automatic.

An additional advantage of the herein-proposed guard structure is that it is usable with knives having fixed cutter blades, i.e. knives wherein the cutter blade is rigidly mounted in the handle so as to be free from wobble or play when the knife is in use.

U.S. Pat. No. 4,086,698 to W. Sparks, shows one prior art knife construction having a guard that includes a shoe carried on a spring-biased plunger. The spring continually urges the shoe and plunger to the protective position. However the person can manipulate the knife so that the shoe presses against the work surface whereby the guard is retracted relative to the knife element, so that the knife element can penetrate the work. The guard operates in a different manner than the guard of the present invention.

J. Peyrot, U.S. Pat. No. 4,757,612, shows a utility knife having a fixed blade and a longitudinally slidable cover movable between a retracted position (FIG. 2), and an extended position overlying the fixed blade (FIG. 1). A manually-operated trigger is pivotably connected to the rear end of the handle to move the cover to its retracted position (by cam action). A major drawback of the Peyrot arrangement is its complexity and use of multiple moving parts. The manufacturing cost would also be relatively high.

U.S. Pat. No. 4,713,885, issued to R. Keklak, M. Couture and J. Whitehouse, shows a utility knife having a retractible cutter element (blade). The guard function is achieved by sliding the blade into the holder (handle) during non-use periods. The patented arrangement has a certain degree of complexity as regards the mechanism used to move the cutter blade out of the holder. As shown in FIG. 2 of the patent drawings, the mechanism includes a slide, pivotable links, a slideway for the link connector, and a squeezable lever. The mechanism is relatively complex.

J. Wood, U.S. Pat. No. 3,999,290, shows a utility knife wherein the cutter blade is slidable into and out of the handle (holder). In this respect the Wood patented device is similar to the devices shown in Peyrot U.S. Pat. No. 4,757,612 and Keklak et al U.S. Pat. No. 4,713,885, discussed above. In the Wood patented arrangement, the blade carrier is equipped with a wire spring arm having a hooked end, whereby the hooked end can catch on the cardboard work surface to draw the cutter blade out of the handle. The arrangement proposed by Wood is considerably different than what is proposed in the present invention.

U.S. Pat. No. 3,781,988, to R. Jones, discloses a utility knife having a guard swingable around a pivot between a retracted position (FIG. 2) and a use position (FIG. 1). An overcenter tension spring holds the guard in its two positions (retracted or extended). The guard is moved to its the retracted position when it is desired to change the cutter element. During normal operation the guard has its nose riding on the work surface to permit the blade to penetrate the work. The principal disadvantage of the patented arrangement would appear to be the cost of manufacture of the guard. The exposed location of spring S would also appear to be a disadvantage, in that the person's fingers could conceivably be pinched between the spring coils, under some circumstances.

Houghton et al, U.S. Pat. No. 4,028,802, shows a specialized yarn (loop) cutting tool having a swingable guard for the blade. The overall arrangement significantly differs from the arrangement of the present invention.

Vito, U.S. Pat. No. 4,531,286, shows a utility knife having a guard attached to the handle by a thin flexible wall. As best shown in FIG. 4, the flexible wall can flex to enable the blade to cut into the work surface. The patented arrangement differs considerably from the arrangement contemplated in the present invention.

Davis et al, U.S. Pat. No. 4,949,458, shows a utility knife having an extendable blade. The patentee states that if the handle is moved violently downwardly a latch member will be actuated to enable a guard (FIG. 4) to be projected out of the holder.

Chomiak, U.S. Pat. No. 5,241,750, shows a guard construction that includes a hood swingable between a protective position (FIG. 1) and a retracted position (FIG. 2). Springs normally hold the hood in its FIG. 1 position. A manual latch normally prevents dislocation of the hood from its FIG. 1 protective position.

The patents discussed above show various types of blade guards for use on utility knives. However, these patents do not show the specific guard structure proposed in the present invention.

SUMMARY OF THE PRESENT INVENTION

The present invention relates to a utility knife, and more particularly, to a utility knife having a spring-loaded guard for protecting the user from cuts when the knife is not in use. The knife element (razor blade) is rigidly mounted in the handle (holder) so as to project from one end of the handle; the spring-loaded guard is pivotably mounted at one edge of the holder for swinging movement between a retracted position lying against the holder (handle), to an operative (protecting) position extending along the cutting edge of the knife element. The guard has a motion arc of about one hundred eighty degrees.

The loading spring for the guard structure is designed to bias the guard element to its blade protecting position automatically when the person releases his grip on the knife handle. The person does not have to think about moving the guard to its protecting position; movement of the guard to its protecting position is automatic.

Further features and advantages of the invention will be apparent from the attached drawings and description of an illustrative embodiment of the invention.

In summary, and in accordance with the above discussion, the foregoing objectives are achieved in the following embodiments.

1. A guard structure for a utility knife, wherein the knife comprises an elongated hollow handle having a leading end, and a planar cutter blade extending from the leading end of said handle; said cutter blade having a cutting edge terminating in a sharpened tip; said guard structure comprising:

an elongated guard element, pivot means for swingably mounting said guard element on the handle around a pivot axis normal to the plane of the cutter blade; and said pivot means being located proximate to the leading end of the handle, such that said guard element is pivotably movable between a protective position extending along the blade cutting edge, and a retracted position extending along the handle.

2. The guard structure, as described in paragraph 1, wherein said guard element has an arcuate motion of approximately one hundred eighty (180) degrees when moving between the protective position and the retracted position.

3. The guard structure, as described in paragraph 1, and further comprising spring means biasing said guard element to its protective position, whereby a manual force is required to move the guard element from its protective position to its retracted position.

4. The guard structure, as described in paragraph 1, and further comprising mounting means for said pivot means, said mounting means having a detachable connection with said knife handle, whereby the guard structure is removable from the knife without affecting knife operability.

5. The guard structure, as described in paragraph 1, and further comprising spring means biasing said guard element to its protective position, whereby manual force is required to move the guard element from its protective position to its retracted position;

said pivot means comprising two ears spaced apart in a direction normal to the plane of the cutter blade, a pivot shaft extending between said ears, and two spaced arms extending from said guard element into the space between said ears; and said arms being rotatable on said pivot to support the guard element for swinging motion around the shaft axis.

6. The guard structure, as described in paragraph 5, wherein said spring means comprises a torsion wire spring coiled around said shaft in the space between said arms.

7. A guard structure for a utility knife, wherein the knife comprises an elongated hollow handle having a leading end, two essentially flat side surfaces, and an elongated side edge connecting said side surfaces; said knife further comprising:

a planar cutter blade extending from the leading end of said handle; said cutter blade having a straight cutting edge terminating in a sharpened cutting tip; said guard structure comprising:

a mounting element detachably secured to the knife element, and a guard element swingably connected to said mounting element;

said mounting element comprising a central wall positionable against the side edge of the knife handle and two spaced ears extending from said wall away from the knife handle;

said guard element comprising an elongated guard member having two spaced arms extending into the space between said ears; and a pivot shaft extending through said arms into said ears, whereby said guard member is swingable between a blade protective position along the blade cutting edge, and a retracted position extending along the side edge of the knife handle.

8. The guard structure, as described in paragraph 7, and further comprising spring means biasing said guard member to its protective position, whereby a manual force is required to move the guard member to its retracted position; and said spring means comprises a torsion spring coiled around said pivot shaft in the space between said arms.

A BRIEF DESCRIPTION OF THE DRAWINGS

DESCRIPTION OF THE PREFERRED EMBODIMENTS OF THE PRESENT INVENTION

Figure 1:
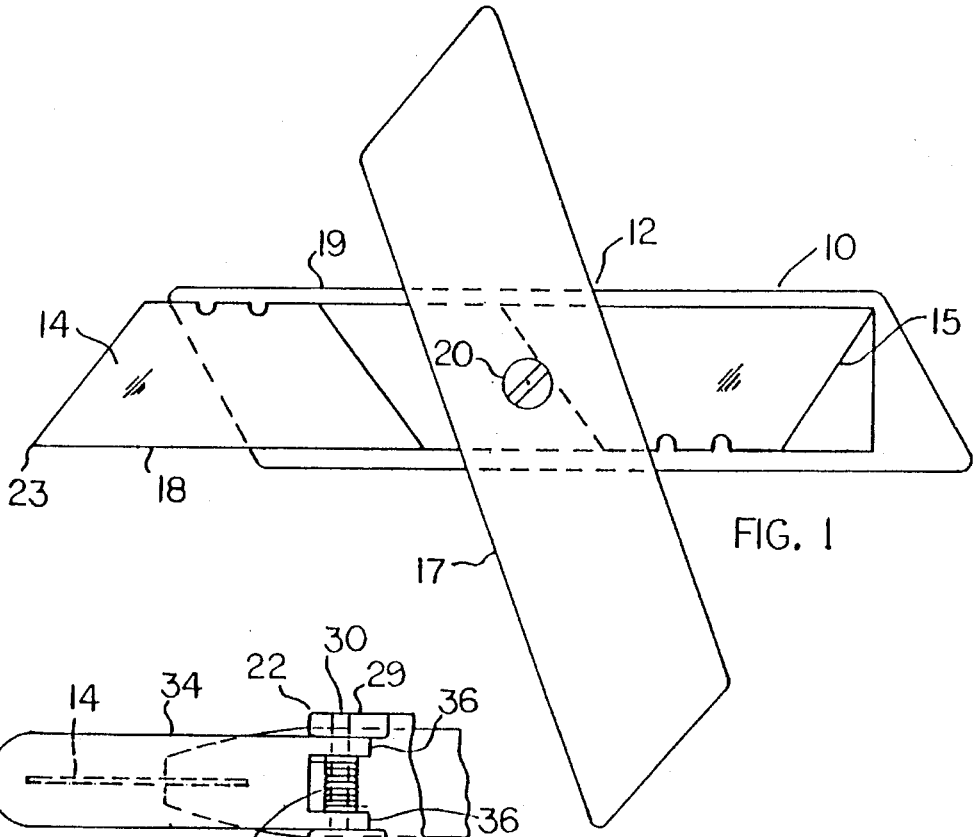
FIG. 1, is a side view, of a utility knife for which the guard structure of the present invention is especially useful. The utility knife is shown in an open condition, suitable for replacing a worn blade with a sharpened blade.
Figure 3:
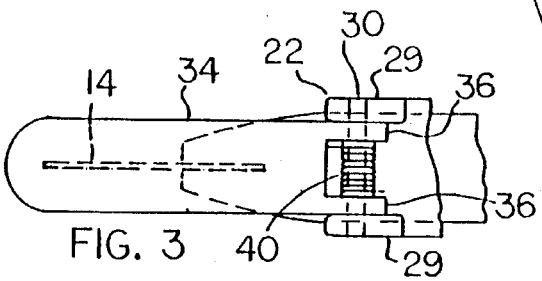
FIG. 3, is a fragmentary edge view, of the FIG. 2 assembly taken in the direction of arrow 3 in FIG. 2.

FIG. 1, is a side view, of a utility knife for which the guard structure of the present invention is especially useful. The utility knife is shown in an open condition, suitable for replacing a worn blade with a sharpened blade.

Referring to FIG. 1, there is shown in simplified form a conventional utility knife 10, that includes an elongated hollow handle 12 and a planar cutter blade 14 extending from the leading end 16 of the handle 12. The handle 12 comprises two half sections, 17 and 19, joined together by a screw 20. The screw 20 extends through a hole in handle half section 17 into a threaded opening in the other handle half section 19.

Figure 2:
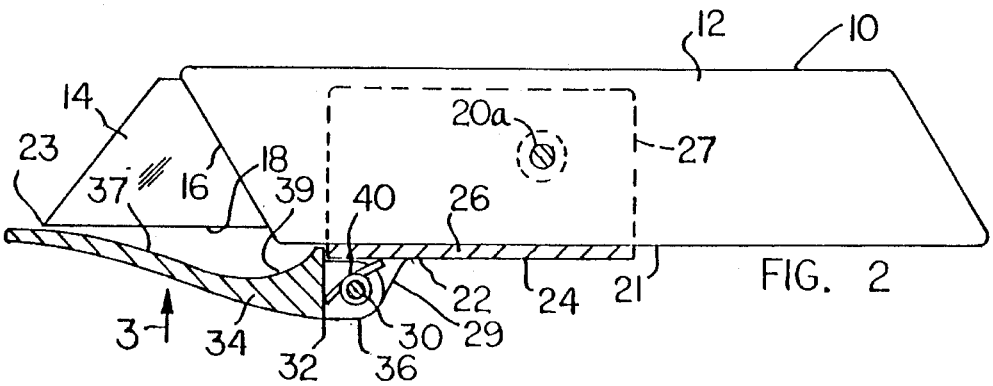
FIG. 2, shows the FIG. 1 utility knife in its closed (operating) position. A guard structure of the present invention is mounted on the knife handle to protect against injury from the sharpened cutter blade.
Figure 4:
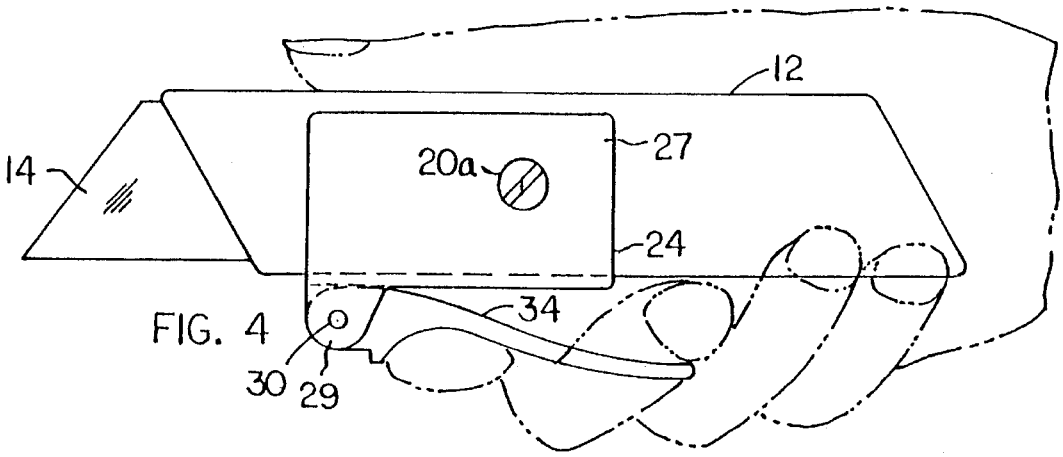
FIG. 4, is a view, taken in the same direction as FIG. 2, but showing the knife structure in an operative cutting position. The guard structure is swung to a retracted position extending along the edge of the knife handle, whereby the person is enabled to exert a gripping force on the guard structure.
Figure 5:
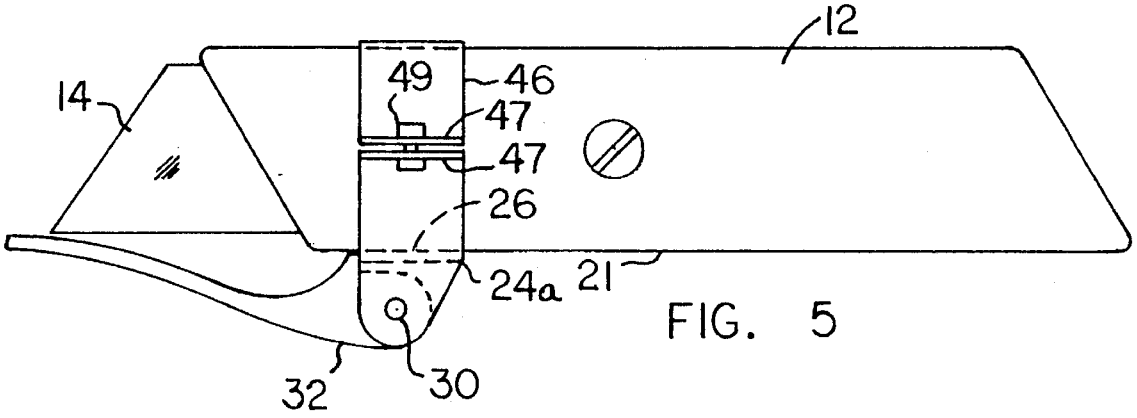
FIG. 5, is a side elevational view, of a utility knife equipped with another guard structure embodying the present invention.

When the screw 20 is tightened the two handle half sections can be rigidly clamped together to form a unitary handle structure, as shown in FIGS. 2, 4 and 5. When screw 20 is loosened, the handle half sections 17 and 19 can be swung around the screw axis to expose the hollow space within the handle. As shown in FIG. 1, the handle interior space can be used to store a second planar cutter blade 15. When blade 14 becomes worn it can be replaced with the sharpened reserve cutter blade 15.

FIG. 2, shows the FIG. 1 utility knife in its closed (operating) position. A guard structure of the present invention is mounted on the knife handle to protect against injury from the sharpened cutter blade.

FIG. 2, shows the FIG. 1 utility knife equipped with a guard structure 22 of the present invention. The knife 10, does not have to be modified, or changed, in order to accommodate guard structure 22. However, it is necessary to use a longer screw (in place of screw 20), since the guard structure 22 is removably secured to the knife handle 12 by means of a screw extending through the handle 12 and a guard structure mounting element 24.

Mounting element 24 comprises a channel structure that includes a central wall 26 and two flanges 27 extending from central wall 26 along the flat side surfaces of handle 12. A screw 20*a* extends through the existing hole structure in the handle 12 and two aligned holes in walls 26, to clamp the mounting element 24 of the guard structure 22 to the knife handle 12. One of the aligned holes will be threaded to mesh with the threaded area of the screw 20*a*. The other hole will be countersunk to accommodate the head of the screw.

Mounting element 24 includes two spaced ears 29 projecting from central wall 26 away from the knife handle 12. A pivot shaft 30 extends between ears 29 in a direction normal to the plane of cutter blade 14, such that shaft 30 is enabled to serve as a pivot means for a guard element 32.

Guard element 32 comprises an elongated guard member 34 having two spaced arms 36 extending into the space between ears 29. Arms 36 have aligned holes therein, slidably encircling pivot shaft 30, whereby the guard element 32 is swingable on shaft 30 between a blade protective position extending along the blade cutting edge 18 (FIG. 2), and a retracted position extending along edge 21 of knife handle 12 (FIG. 4).

Elongated guard member 34 has sufficient length to extend beyond sharpened tip 23 of blade 14 when the guard 34 is in its FIG. 2 protective position. Also, surface 37 of guard member 34 has a concave surface area 39 designed to fit comfortably on the person's first finger when the guard element is in its retracted position (FIG. 4).

FIG. 4, is a view, taken in the same direction as FIG. 2, but showing the knife structure in an operative cutting position. The guard structure is swung to a retracted position extending along the edge of the knife handle, whereby the person is enabled to exert a gripping force on the guard structure.

FIG. 4, shows in phantom a representative outline of the person's hand gripping the knife handle 12 and the guard element 32 during use of the knife for cutting purposes. The presence of the guard element 32 tends to enhance the handgrip, whereby the knife has a lessened tendency to slip out of the person's hand during usage of the knife for cutting purposes.

A spring mechanism is provided for biasing guard element 32 to its blade protective position (FIG. 2). As shown in the drawing, the spring mechanism comprises a torsion wire spring 40 having a multiple number of turns encircling pivot shaft 30. Opposite ends of the wire spring 40 abut against wall 26 of the mounting element 24 and an interior surface on guard element 32 to anchor the spring; the spring 40 is pre-loaded to exert a clockwise biasing force on guard element 32 (as viewed in FIG. 2).

When the person releases his grip on guard element 32, spring 40 automatically swings the guard element 32 to the FIG. 2 protective position; the left end edge of wall 26 acts as a stop to limit the swinging movement of guard element 32. Guard element 32 may be swung to its FIG. 4 position by exerting finger pressure on the protruding tip of member 34. During use of the knife for cutting purposes the guard element 32 is in its FIG. 4 position.

The guard structure can be removed from the utility knife by removing screw 20*a*, and replacing it with the original screw 20. The guard structure can be supplied as an entity separate from the knife, such that the guard structure can be used on pre-existing knives.

FIG. 5, is a side elevational view, of a utility knife equipped with another guard structure embodying the present invention.

FIG. 5, shows an alternative guard construction that can be used in practice of the invention. In this case the mounting element 24*a* comprises a central wall 26 engaging the edge 21 of knife handle 12, and a band mechanism 46 extending from wall 26 around the knife handle 12. The band mechanism 46 is split to form two flanges 47 that are spaced apart slightly when the band mechanism 46 is on the knife handle. A nut-screw assembly 49 is used to draw the flanges 47 toward each other, whereby the mounting element 24*a* is clamped to the knife handle.

The relationship between mounting element 24*a* and the guard element 32 is similar to the relationship between elements 24 and 32 in the FIG. 2 embodiment. Thus, the FIG. 5 embodiment differs from the FIG. 2 embodiment only as respects the mechanism used to mount the guard structure on the knife handle 12.

The present invention, described above, relates to a Protective Guard for a Utility Knife. Features of the present invention are recited in the appended claims. The drawings contained herein necessarily depict structural features and embodiments of the Protective Guard for a Utility Knife, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A guard structure for a utility knife, wherein the knife comprises an elongated hollow handle having a leading end, and a planar cutter blade extending from the leading end of said handle; said cutter blade having a cutting edge terminating in a sharpened tip;

said guard structure comprising:

an elongated guard element, pivot means for swingably mounting said guard element on the handle around a pivot axis normal to the plane of the cutter blade;

said pivot means being located proximate to the leading end of the handle, such that said guard element is pivotably movable between a protective position extending along the blade cutting edge, and a retracted position extending along the handle; said guard element having an arcuate motion of approximately one hundred eighty (180) degrees when moving between the protective position and the retracted position;

said pivot means comprising two ears (29) spaced apart in a direction normal to the plane of the cutter blade, a pivot shaft (30) extending between said ears, and two spaced arms (36) extending from said guard element into the space between said ears; said arms being rotatable on said pivot shaft to support the guard element for swinging movement; and spring means (40) exerting a uni-directional force on said guard element to bias said guard element toward its protective position irrespective of the guard element position; said spring means being located between said spaced arms.

2. The guard structure as described in claim 1, wherein said spring means comprises a torsion wire spring coiled around said shaft in the space between said arms.

3. A guard structure for a utility knife, wherein the knife comprises an elongated hollow handle having a leading end, two essentially flat side surfaces, and an elongated side edge connecting said side surfaces; said knife further comprising a planar cutter blade extending from the leading end of said handle; said cutter blade having a straight cutting edge terminating in a sharpened cutting tip;

said guard structure comprising:

a mounting element detachably secured to said handle, and a guard element swingably connected to said mounting element;

said mounting element comprising a central wall (26) positionable against the side edge of the knife handle and two spaced ears (29) extending from said wall away from the knife handle;

said guard element comprising an elongated guard member having two spaced arms (36) extending into the space between said ears;

a pivot shaft extending through said arms into said ears, whereby said guard member is swingable between a blade protective position along the blade cutting edge and a retracted position extending along the side edge of the knife handle; and spring means (40) exerting a uni-directional force on said guard element, to bias said guard element toward its protective position irrespective of the guard element position.

4. The guard structure as described in claim 3, wherein said spring means comprises a torsion spring coiled around said pivot shaft in the space between said arms.

5. A guard structure for a utility knife, wherein the knife comprises an elongated hollow handle having a leading end, and a planar cutter blade extending from the leading end of said handle; said cutter blade having a cutting edge terminating in a sharpened cutting tip;

said guard structure comprising:

an elongated guard element, and pivot means for swingably mounting said guard element on the handle around a pivot axis normal to the plane of the cutter blade;

said pivot means being located proximate to the leading end of the handle, such that said guard element is pivotably movable between a protective position extending along the blade cutting edge, and a retracted position extending along the handle; said guard element having an arcuate motion of approximately one hundred eighty (180) degrees when moving between the protective position and the retracted position; and spring means (40) exerting a uni-directional force on said guard element to bias said guard element toward its protective position irrespective of the guard element position.

* * * * *